US007066342B2

(12) United States Patent
Baechle et al.

(10) Patent No.: US 7,066,342 B2
(45) Date of Patent: Jun. 27, 2006

(54) MODULAR PACKAGING SYSTEM FOR SHIPPING AND DISPLAYING PALLETIZED RETAIL PRODUCTS

(75) Inventors: James Baechle, Hendersonville, TN (US); Thomas H. Radford, Gallatin, TN (US)

(73) Assignee: Sonoco Development, Inc., Hartsville, SC (US)

( * ) Notice: Subject to any disclaimer, the term of this patent is extended or adjusted under 35 U.S.C. 154(b) by 57 days.

(21) Appl. No.: 10/605,814

(22) Filed: Oct. 29, 2003

(65) Prior Publication Data

US 2005/0092637 A1 May 5, 2005

(51) Int. Cl.
*A67F 5/00* (2006.01)

(52) U.S. Cl. ..... 211/191; 211/194; 206/600

(58) Field of Classification Search ..... 208/180, 208/186, 190; 211/126.6, 186, 188, 126.2, 211/189, 190, 191, 194, 206; 294/94; 229/199; 206/511, 512, 586, 432, 497, 597, 600; 414/626
See application file for complete search history.

(56) References Cited

U.S. PATENT DOCUMENTS

| | | | | | |
|---|---|---|---|---|---|
| 387,267 | A | * | 8/1888 | Talbot | 108/190 |
| 3,730,601 | A | * | 5/1973 | Misenheimer, III | 312/108 |
| 3,741,404 | A | * | 6/1973 | Jourdain | 108/91 |
| 3,877,396 | A | * | 4/1975 | Patterson | 108/183 |
| 4,050,386 | A | * | 9/1977 | Kellogg | 108/190 |
| 4,158,336 | A | * | 6/1979 | Brescia et al. | 108/190 |
| 4,266,714 | A | * | 5/1981 | Crane | 206/509 |
| 4,311,237 | A | * | 1/1982 | Hayes | 206/503 |
| 4,579,233 | A | * | 4/1986 | Hepp | 211/126.12 |
| 4,638,745 | A | * | 1/1987 | Sheffer | 108/192 |
| 4,673,092 | A | * | 6/1987 | Lamson et al. | 211/188 |
| 4,705,162 | A | | 11/1987 | Kupersmit | |
| 4,801,024 | A | | 1/1989 | Flum et al. | |
| 4,865,202 | A | | 9/1989 | Day | |
| 4,877,137 | A | | 10/1989 | Govang et al. | |
| 5,016,761 | A | | 5/1991 | Stoddard et al. | |
| 5,035,323 | A | | 7/1991 | Daniels et al. | |
| 5,125,520 | A | * | 6/1992 | Kawasaki | 211/133.1 |
| 5,251,753 | A | | 10/1993 | Pigott et al. | |
| 5,275,289 | A | | 1/1994 | Blatt | |
| 5,370,233 | A | | 12/1994 | Schutz et al. | |
| 5,896,995 | A | | 4/1999 | Murray et al. | |
| 5,938,036 | A | | 8/1999 | Villemure | |
| 6,012,581 | A | | 1/2000 | Galazzo | |
| 6,062,150 | A | * | 5/2000 | Sikora et al. | 108/190 |
| 6,109,857 | A | * | 8/2000 | Trygg | 414/626 |
| 6,267,255 | B1 | | 7/2001 | Brush | |
| 6,378,764 | B1 | * | 4/2002 | Teixidor Casanovas | 229/191 |

FOREIGN PATENT DOCUMENTS

| | | | |
|---|---|---|---|
| GB | 2232344 | A * | 12/1990 |
| JP | 07276543 | A * | 10/1995 |

* cited by examiner

*Primary Examiner*—Mickey Yu
*Assistant Examiner*—Jerrold Johnson
(74) *Attorney, Agent, or Firm*—Clausen Miller, P.C.

(57) ABSTRACT

A modular packaging system for shipping and displaying palletized products comprising vertically stacked trays for holding the products, formed tubular spacer sleeves located over openings in each tray such that their hollow interiors communicate with the openings, and support posts inserted inside the spacer sleeves and through the tray openings to lock the trays together. The system is strong enough not only to support the weight of the products on the trays and withstand the vibration and impact forces that can occur during shipping, but to withstand the weight of one or more units stacked on top.

5 Claims, 3 Drawing Sheets

MODULAR PACKAGING SYSTEM FOR SHIPPING AND DISPLAYING PALLETIZED RETAIL PRODUCTS

BACKGROUND OF INVENTION

This patent relates to a modular packaging system for shipping and displaying palletized products. More particularly, this patent relates to a system for packaging multiple products, including irregularly-shaped products, on a pallet to be shipped to a retailer, who then may display the products in the packaging in which they are shipped.

Mass merchandising retailers, such as "club store" retailers, often display their products on the pallets on which the products were shipped from their vendors. The products in their primary packages (what the consumer actually buys) are arranged in multiple layers using secondary packaging systems. The primary purpose of the secondary packaging system is to contain and organize sub-groups of primary packaging, as well as improve the stacking strength of the palletized unit. There are two types of secondary packaging systems: those in which multiple trays are supported by the products themselves, and those in which the trays supported wholly or partly by partitions.

The use of partitions between each tray can help improve stacking strength. However, club store shoppers can find it difficult to view products on palletized displays due to the partitions and other secondary packaging elements that obscure the products. Another disadvantage of partitions is that they add to the packaging cost and can result in poor sales appeal for the club store operators.

The objective of the present invention is to provide a packaging system for the shipping and display of palletized products that increases stacking strength, enhances product visibility and reduces packaging waste which, in turn, reduces material cost.

Another objective of the present invention is to provide a packaging system that enables the point of purchase mass merchandiser to raise the level of the remaining product layers when the top layers have been emptied of products.

Further and additional objects will appear from the description, accompanying drawings, and appended claims.

SUMMARY OF INVENTION

The present invention is a modular packaging system for shipping and displaying palletized products. The system comprises vertically stacked trays for holding the products, hollow spacer sleeves affixed over openings in each tray such that their hollow interiors communicate with the openings, and support posts inserted inside the spacer sleeves and through the tray openings to lock the trays together. The bottom tray rests on a standard pallet. The entire assembly may be wrapped in transparent plastic film to protect the products from dust and damage.

The system is strong enough not only to support the weight of the products on the trays and withstand the vibration and impact forces that can occur during shipping, but to withstand the weight of one or more units stacked on top. The system is particularly suited for shipping and displaying irregularly shaped items and items that cannot withstand vertical stacking forces, such as soft-packaged goods, since the system can bear the entire stacking load.

DETAILED DESCRIPTION

Figure 1:
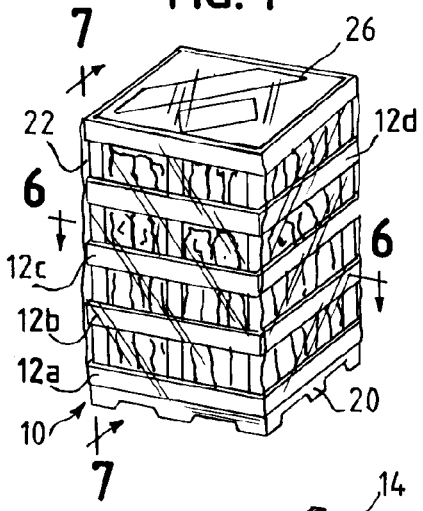
FIG. 1 is a perspective view of one embodiment of a modular packaging system according to the present invention.
Figure 2:
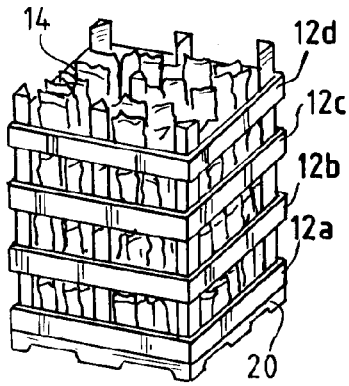
FIG. 2 is a perspective view of the system of FIG. 1 after the plastic wrap and top cap have been removed.

Turning to the drawings, there is shown in FIGS. 1–16 one embodiment of the present invention, a modular packaging system 10 for shipping and displaying retail products in a mass merchandising environment. The packaging system comprises a plurality of trays 12 for holding products 14 in their primary packaging, spacer sleeves 16 that support the trays 12, and support posts 18 that key inside the spacer sleeves 16 to lock the system together and help stabilize the trays 12. The tray and post assembly may be carried on a standard pallet 20 and wrapped in an outer wrap 22 to protect the products 14 from dust and damage during shipment.

The trays 12 preferably are formed from corrugated board, although any suitable material may be used. Each tray 12 has die-cut openings 24 disposed therein which are large enough to accommodate the support posts 18 but smaller than the spacer sleeves 16. The number of openings 24 in each tray 12 is a function of the number of support posts 18 used. Typical modular packaging systems 10 include four post, five post, six post, seven post and eight post layouts, as shown in FIGS. 11–15, depending on the nature of the products and the stacking requirements of the system.

Figure 15:
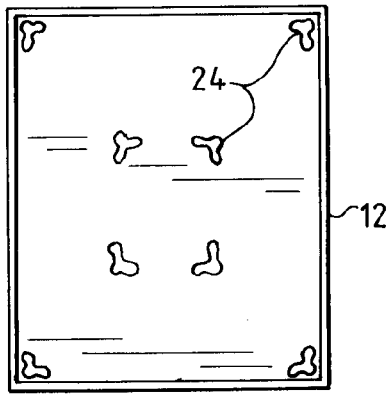
FIG. 15 is a top plan view of a tray for an eight-post modular packaging system.

The support posts 18, and thus the die-cut openings 24, may be arranged in any suitable fashion, although it is preferred that there be an opening 24 at each corner of the trays 12. In the five post layout (FIG. 12) the fifth opening preferably is located in the center of the trays 12. In the six post layout (FIG. 14) it is preferred that the fifth and sixth openings 24 be located near the two longer tray sides (assuming the tray is rectangular) equidistant from the two shorter sides. Preferably, the seven post layout (FIG. 13) is similar to the six post layout but includes a seventh opening 24 in the center of the tray 12. As shown in FIG. 15, the eight post layout preferably includes four openings 24 located at the four tray corners and four other openings 24 arranged in a smaller rectangular configuration about the tray center.

Each tray 12 comprises a bottom panel 13 for supporting the products 14 and short side panels 15 extending upward from the perimeter of the bottom panel 13. The bottom panel 13 and/or side panels 15 may be printed or otherwise decorated in any desirable fashion to increase the aesthetic appeal of the display.

Additional means for helping to keep the products 14 in place may be employed. For example, optional dividers (not shown) may be placed around the individual products 14 on each tray 12, although these dividers need not be load bearing. Openings may be die cut into the tray bottom panels 13 to allow the products 14 to sit into the trays 12 and extend below the tray bottom panels 13. Inserts with die cut openings for receiving the bottoms of the products 14 may be placed in the trays 12. Sticky clean peel adhesive sheets may be placed on the trays 12 under the products 14 to help keep the products 14 secure.

The spacer sleeves 16 evenly space the trays 12 apart and provide a platform on which additional trays 12 may be placed. The height of the spacer sleeves 16 is determined by the height of the products 14 in their primary packaging or, more particularly, the desired height between trays 12. The spacer sleeves 16 may be pre-attached to the trays 12 in some fashion, such as by adhesive, tape or staples, and are over each opening 24 so that their hollow interiors communicate with the openings 24.

Figure 9:
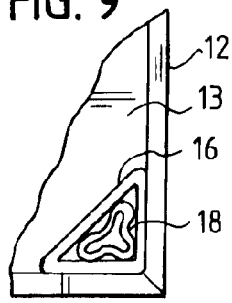
FIG. 9 is a partial top view of a tray to show how a support post fits inside a spacer sleeve.
Figure 10:
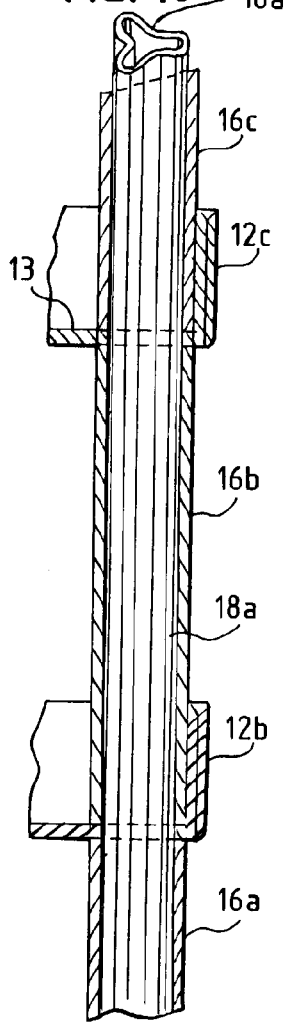
FIG. 10 is a cross-sectional view of the assembled system of FIG. 8 taken along line 10—10.
Figure 11:
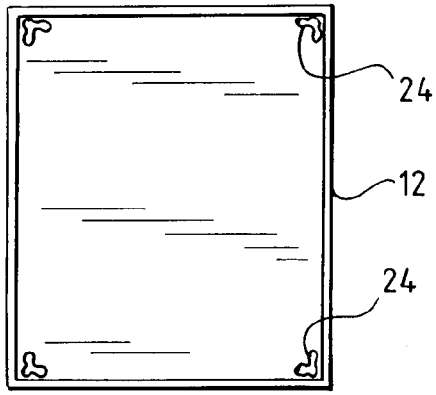
FIG. 11 is a top plan view of a tray for a four-post modular packaging system.
Figure 16:
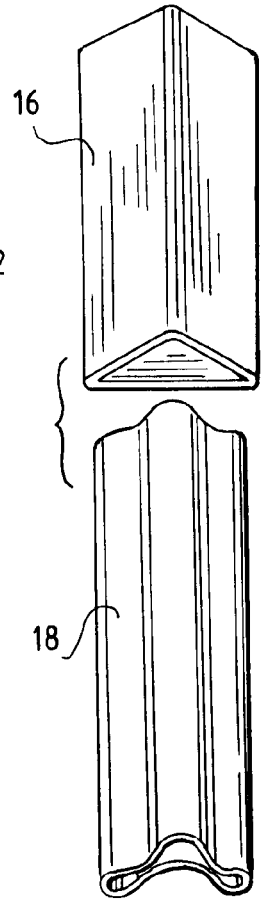
FIG. 16 is a side perspective view of a support post and spacer sleeve.
Figure 12:
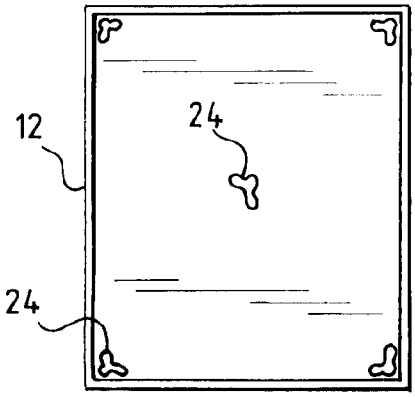
FIG. 12 is a top plan view of a tray for a five-post modular packaging system.
Figure 13:
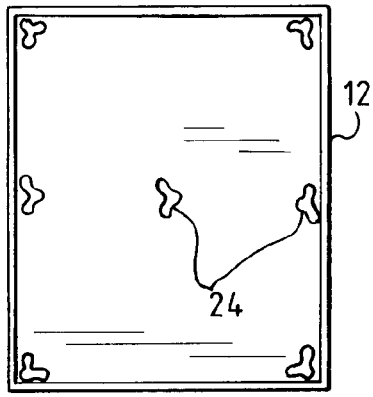
FIG. 13 is a top plan view of a tray for a seven-post modular packaging system.
Figure 14:
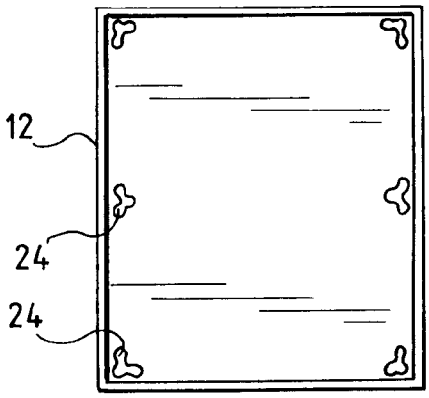
FIG. 14 is a top plan view of a tray for a six-post modular packaging system.

Preferably, the spacer sleeves 16 are hollow paper tubes formed into a desired shape, such as those marketed by Sonoco Products Company of Hartsville, S.C. and described in U.S. Pat. Nos. 4,482,054; 5,593,039; 6,059,104 and 6,186,329, incorporated herein by reference. In the embodiment illustrated in the figures and as shown in FIGS. 9, 10 and 16, the sleeves 16 have a substantially triangular cross-sectional profile, although any suitable cross-sectional shape may be used, including circular and rectangular. Since the sleeves 16 are visible to the consumer, they too may be printed or otherwise decorated in any desirable fashion to increase the aesthetic appeal of the display.

The support posts 18 must be small enough to slide inside the spacer sleeves 16 and through the openings 24 in the trays 12. Like the spacer sleeves 16, the support posts 18 may be wound paper tubes such as those manufactured by Sonoco Products Company. The support posts 18 may have any suitable cross-sectional shape, including but not limited to triangular, and should fit snugly inside the spacer sleeves 16.

The length of the support posts 18 is a function of the length of the spacer sleeves 16 and number of trays 12. The support posts 18 must be long enough to extend through more than one set of spacer sleeves 16 in order to hold multiple trays 12 together. For example, in the four layer system illustrated in the figures and described in detail below, two sets of support posts 18*a*, 18*b* are used. The bottom set of support posts 18*a* are long enough to extend through two and one-half spacer sleeves 16, and the top set of support posts 18*b* are long enough to extend through about one and one-half spacer sleeves 16.

Figure 8:
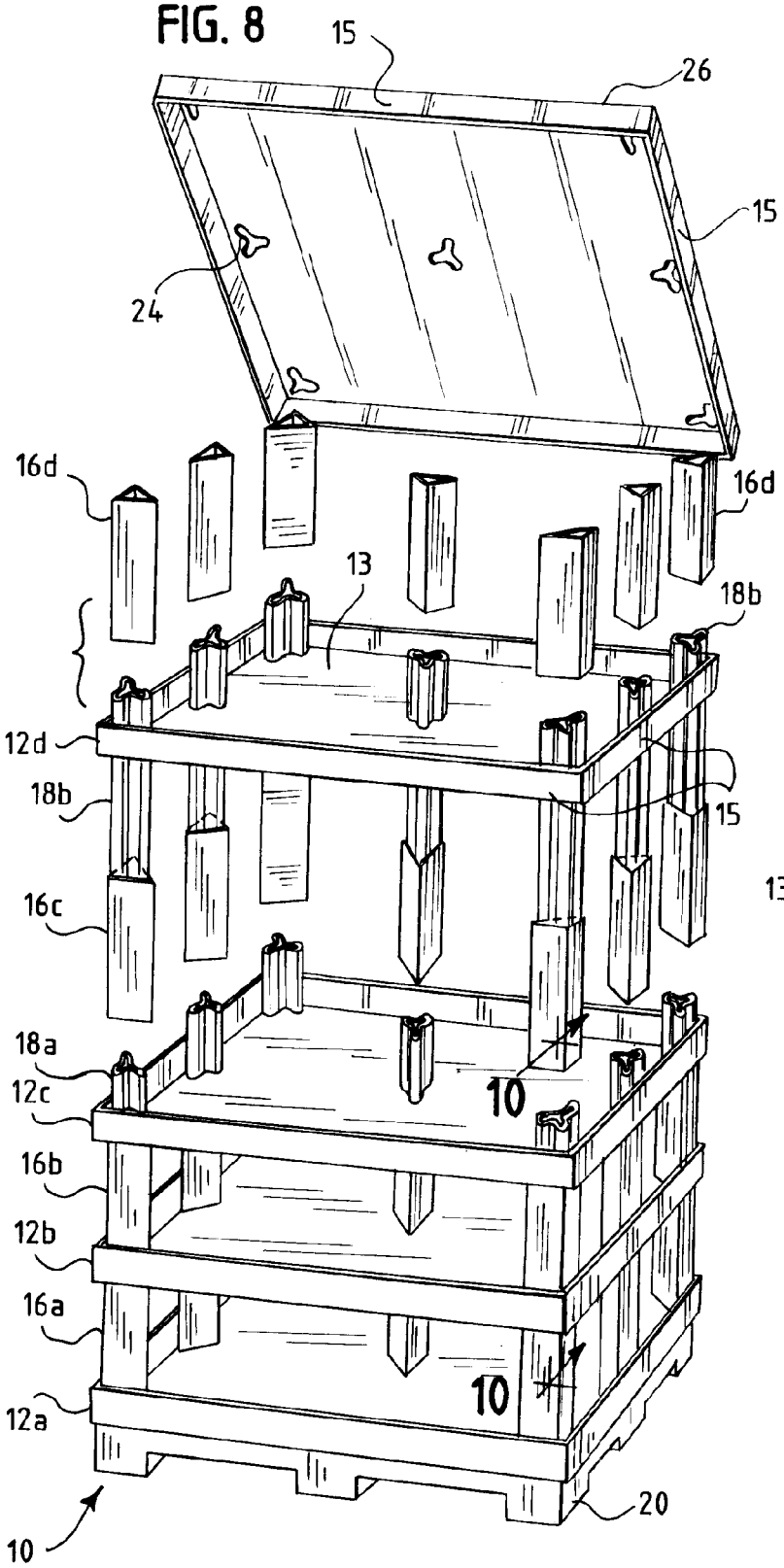
FIG. 8 is an exploded perspective view of the modular packaging system of FIG. 1 shown without the outer wrap and products.

Any number of product display layers can be achieved with the invention. By way of example only, and without limitation as to the scope of the invention, to assemble the four layer packaging system 10 of FIG. 8, the product wholesaler (vendor) places a first tray 12*a*, preferably with pre-attached spacer sleeves 16*a*, on a standard pallet 20. Next, the vendor slides the support posts 18*a* into the spacer sleeves 16*a* and places the products 14 (not shown in FIG. 8), already in their primary packages, onto the first tray 12*a*. The vendor then places a second tray 12*b* and spacer sleeves 16*b* over the first layer like a platform and places products 14 onto the second tray 12*b*. A portion of each support post 18*a* will extend above the spacer sleeves 16*b* of the second tray 12*b*. Next, the vendor places a third tray 12*c* and spacer sleeves 16*c* over the second layer and places products 14 onto the third tray 12*c*. As with each layer, the spacer sleeves 16*c* may be pre-attached to the tray 12*c* or they may be unattached as shown in FIG. 8. The support posts 18*a* extend into only a lower portion of the spacer sleeves 16*c* of the third layer.

The vendor then inserts a second set of support posts 18*b* into the upper portion of the spacer sleeves 16*c* of the third layer 12*c* and repeats the stacking process for layer four. When finished, the second set of support posts 18*b* extend through the upper portion of the third layer spacer sleeves 16*c* and through all or part of the fourth layer spacer sleeves 16*d*.

An optional fifth tray (without attached spacer sleeves) may be placed over the fourth tray 12*d* to serve as a top cap 26 by inverting the fifth tray 26 so that its side panels 15 extend downward and securing the top cap 26 to the upwardly extending spacer sleeves 16*d* by fitting the spacer sleeves 16*d* snugly within the top cap side panels 15. Finally, the entire assembly 10 may be wrapped in transparent plastic film 22 (see FIG. 1) to protect the products 14 from dust and damage during shipment.

Figure 3:
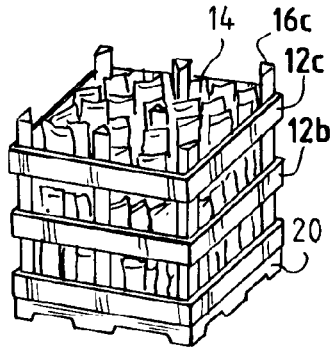
FIG. 3 is a perspective view of the system of FIG. 2 after the top tray has been removed.
Figure 4:
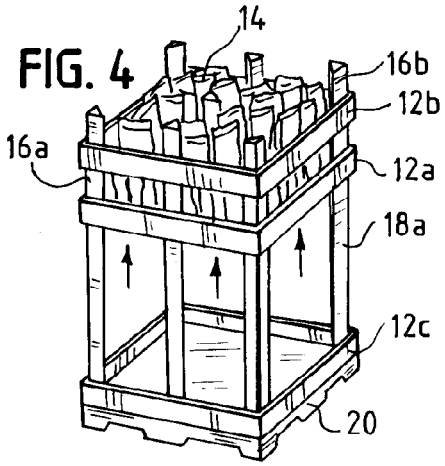
FIG. 4 is a perspective view of the system of FIG. 3 after the top tray has been removed and the remaining trays raised.
Figure 5:
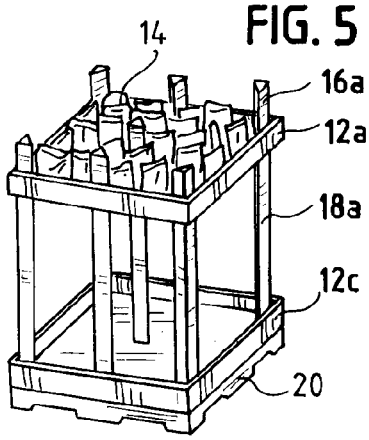
FIG. 5 is a perspective view of the system of FIG. 4 after the top tray has been removed.
Figure 6:
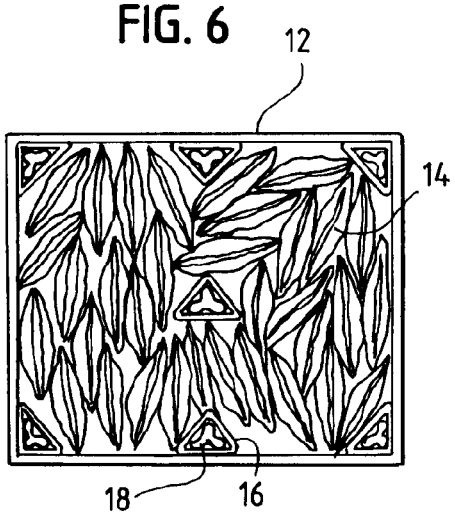
FIG. 6 is a cross-sectional view of the system of FIG. 1 taken along line 6—6.
Figure 7:
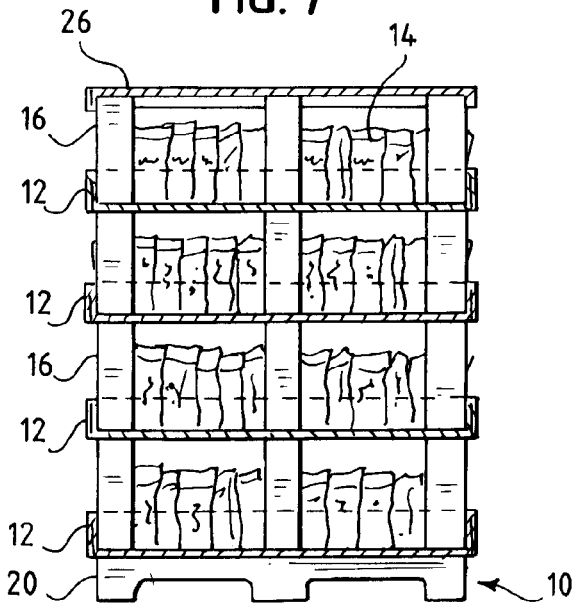
FIG. 7 is a cross-sectional view of the system of FIG. 1 taken along line 7—7.

An added benefit of the present system is the ability of the point of purchase mass merchandiser to raise the level of the remaining trays 12 when the top trays 12 have been emptied of products 14, thereby bringing the products 14 closer to the consumer's eye (and purchasing) level. For example, in the system 10 of FIG. 1 (shown with products 14 but with the outer wrap 22 and top cap 26 removed in FIG. 2), when the top tray 12*d* is emptied of products 14, the empty top tray 12*d*, the topmost set of spacer sleeves 16*d* and the upper set of support posts 18*b* may be removed to better expose the products 14 on the next tray 12*c*, as shown in FIG. 3.W When the next tray 12*c* is emptied of products 14, the bottom two trays 12*a*, 12*b* may be raised by removing the empty tray 12*c* (and the spacer sleeves 16*c*), lifting the bottom two trays 12*a*, 12*b*, spacer sleeves 16*a*, 16*b* and support posts 18*a* off the pallet 20, sliding the support posts 18*a* out of the spacer sleeves 16*a*, 16*b*, placing the empty tray 12*c* (with spacer sleeves 16*c*) on the pallet 20, inserting the support posts 18*a* into the spacer sleeves 16*c*, and placing the product laden trays 12*a*, 12*b* onto the upwardly extending support posts 18*a* such that the posts 18*a* extend at least partway through the spacer sleeves 12*a*, 12*b*. The rearranged system will then appear as shown in FIG. 4. When the third tray 12*b* is emptied of products it can be removed to better expose the final tray 12*a*, as shown in FIG. 5.

Thus there has been described a modular packaging system for shipping and displaying palletized products. The system enhances product visibility by eliminating the need for dividers or partitions and by enabling the point of purchase retailer to raise the level of the display trays to a better viewing and purchasing height. The system reduces packaging waste and material costs by eliminating the need for dividers and other support structures. The system is strong enough not only to support the weight of the products on the trays and withstand the vibration and impact forces that can occur during shipping, but also to withstand the weight of one or more units stacked on top. The system is particularly suited for shipping and displaying irregularly shaped items or items that cannot withstand vertical stacking forces, such as soft-packaged products, since the system can bear the entire stacking load.

Other modifications and alternative embodiments of the invention are contemplated that do not depart from the scope of the invention as defined by the foregoing teachings and appended claims. It is intended that the claims cover all such modifications that fall within their scope.

The invention claimed is:

1. A packaging system for shipping and displaying products, the system comprising:

a bottom cap having a rectangular bottom panel and four side panels extending upwardly from the bottom panel, the bottom and side panels defining four corners;

a top cap having a top panel and four side panels extending downwardly from the top panel, the top and side panels defining four corners;

two or more vertically aligned trays disposed between the bottom and top caps, each tray comprising a rectangular bottom panel having a thickness, four side panels extending upwardly from the tray bottom panel, the tray bottom and side panels defining four corners, each tray further comprising openings disposed in and extending through the tray bottom panel and located near each tray corner, each opening being vertically aligned with an opening or openings in the other tray or trays to define a set of vertically aligned tray openings;

outer spacer sleeves located above and below each tray opening and having hollow interiors that communicate with the tray opening, each outer spacer sleeve being aligned with at least one other outer spacer sleeve to define a set of vertically aligned outer spacer sleeves; and one or more inner support posts extending through each set of vertically aligned outer spacer sleeves and the corresponding set of vertically aligned tray openings to hold the trays and outer spacer sleeves in position;

wherein each tray and the top cap are supported by outer spacer sleeves, and wherein the total height of the one or more inner support posts is equal to the total height of the corresponding set of vertically aligned outer spacer sleeves and the total thickness of the bottom panels of the two or more trays, thereby enabling the one or more inner support posts to bear the load of anything stacked on top of the packaging system.

2. The packaging system of claim 1 wherein the number of the one or more inner supports posts is one and the inner support post extends from the bottom cap bottom panel to the top cap top panel.

3. The packaging system of claim 1 wherein the number of the one or more inner supports posts is two or more, each inner support post comprises opposing ends, the inner support posts are aligned end to end, and facing inner support post ends abut each other inside an outer spacer sleeve.

4. The packaging system of claim 1 wherein the outer spacer sleeves have two orthogonal longitudinal sides that abut adjacent side panels of the top and bottom caps for increased stability.

5. The packaging system of claim 1 wherein the outer spacer sleeves and the inner support posts are preformed paper tubes.

* * * * *